US011820027B2

(12) United States Patent
Scimone et al.

(10) Patent No.: US 11,820,027 B2
(45) Date of Patent: Nov. 21, 2023

(54) EVERYDAY FOLDING UTILITY CUTTER

(71) Applicant: Slice, Inc., San Jose, CA (US)

(72) Inventors: Thomas Scimone, Campbell, CA (US); Fu Keung Ng, Kowloon (HK)

(73) Assignee: Slice, Inc., Sunny Isles, FL (US)

( * ) Notice: Subject to any disclaimer, the term of this patent is extended or adjusted under 35 U.S.C. 154(b) by 0 days.

(21) Appl. No.: 16/876,361

(22) Filed: May 18, 2020

(65) Prior Publication Data

US 2021/0354318 A1 Nov. 18, 2021

(51) Int. Cl.
*B26B 1/04* (2006.01)
*B26B 5/00* (2006.01)

(52) U.S. Cl.
CPC ..... *B26B 1/04* (2013.01); *B26B 5/006* (2013.01)

(58) Field of Classification Search
CPC ..... B26B 1/044; B26B 1/048; B26B 1/02; B26B 1/04; B26B 1/046; B26B 1/06; B26B 5/00; B26B 5/006
USPC ..... 30/158–161, 153, 155–161
See application file for complete search history.

(56) References Cited

U.S. PATENT DOCUMENTS 1,743,022 A * 1/1930 Carman ..... B26B 1/02 30/161
4,606,123 A * 8/1986 Wrench ..... B26B 11/006 30/153
5,331,741 A * 7/1994 Taylor, Jr. ..... B26B 1/02 30/160
5,537,750 A * 7/1996 Seber ..... B26B 1/044 30/161
6,079,106 A * 6/2000 Vallotton ..... B26B 1/048 30/161
6,101,723 A * 8/2000 Ford ..... B26B 1/046 30/160
6,145,202 A * 11/2000 Onion ..... B26B 1/048 30/160
6,293,020 B1 * 9/2001 Julien ..... B21K 11/02 30/346.53
6,397,476 B1 * 6/2002 Onion ..... B26B 1/048 30/161
6,397,477 B1 * 6/2002 Collins ..... B26B 1/046 30/161
6,446,341 B1 * 9/2002 Wang ..... B26B 5/00 30/161
6,553,671 B2 * 4/2003 Blanchard ..... B26B 1/046 30/161
7,080,457 B2 * 7/2006 Sullivan ..... B26B 1/046 30/160
7,134,207 B2 * 11/2006 Ping ..... B26B 5/00 30/156
7,296,355 B2 * 11/2007 Onion ..... B26B 1/02 30/161

(Continued)

*Primary Examiner* — Jason Daniel Prone
(74) *Attorney, Agent, or Firm* — McCarter & English, LLP; James M. Smedley; Alex Korona

(57) ABSTRACT

A foldable cutting device having a handle component and a blade holder component pivotally connected to the handle component. The foldable cutting device is movable between a closed position, in which the blade holder rests within a chamber in the handle component, and an open position, in which the blade holder pivots out from the handle. The foldable cutting device may have a release mechanism for assisting in the opening of the blade holder. The release mechanism may utilize tension components to assist in biasing the blade holder towards the open position.

20 Claims, 4 Drawing Sheets

(56) References Cited

U.S. PATENT DOCUMENTS 7,325,312 B1 * 2/2008 Janich ..... B26B 1/048 30/161
7,380,341 B2 * 6/2008 Ping ..... B26B 5/00 30/161
8,353,109 B2 * 1/2013 Rohrbach ..... B26B 5/003 30/151
8,776,380 B1 * 7/2014 Quimby ..... B26B 5/003 30/158
9,505,141 B2 * 11/2016 Duey ..... B26B 1/048
9,579,808 B2 * 2/2017 Scimone ..... B26B 1/00
D788,554 S * 6/2017 Scimone ..... B26B 1/02 D8/20
D788,555 S * 6/2017 Scimone ..... B26B 5/005 D8/20
9,925,674 B2 * 3/2018 Scimone ..... B26B 1/00
10,124,495 B2 * 11/2018 Gallegos ..... B26B 5/001
10,179,416 B2 * 1/2019 Wang ..... B26B 1/042
10,894,329 B1 * 1/2021 Mandeville ..... B26B 1/042
10,994,428 B2 * 5/2021 Gallegos ..... B26B 5/001
11,097,434 B2 * 8/2021 Hooper ..... B26B 5/005
11,192,267 B1 * 12/2021 Omelchenko ..... B26B 1/048
11,279,050 B2 * 3/2022 Onion ..... B26B 5/00
D959,948 S * 8/2022 Scimone ..... B26B 5/00 D8/99
2005/0072004 A1 * 4/2005 Carter, III ..... B26B 1/02 30/159
2006/0272157 A1 * 12/2006 Zeng ..... B26B 1/048 30/161
2008/0250650 A1 * 10/2008 Seber et al. ..... B26B 5/001 30/161
2008/0289191 A1 * 11/2008 LeBlanc et al. ..... B26B 5/00 30/160
2009/0165309 A1 * 7/2009 Kamb et al. ..... B26B 1/02 30/161
2009/0199408 A1 * 8/2009 Zeng ..... B26B 5/001 30/152
2009/0255127 A1 * 10/2009 Seymour et al. ..... B26B 1/02 30/161
2010/0263214 A1 * 10/2010 Robinson et al. ..... B26B 5/00 30/156
2011/0167647 A1 * 7/2011 Gringer et al. ..... B26B 1/048 30/156
2012/0260505 A1 * 10/2012 Qiu ..... B26B 5/00 30/165
2014/0259686 A1 * 9/2014 Garavaglia et al. .... B26B 5/003 30/156
2016/0207207 A1 * 7/2016 Tom et al. ..... B26B 1/048
2017/0120461 A1 * 5/2017 Tom et al. ..... G06F 3/03545
2017/0120463 A1 * 5/2017 Pelletier ..... B26B 1/046
2017/0259441 A1 * 9/2017 Scimone ..... B26B 9/00
2018/0099423 A1 * 4/2018 Mundhra ..... B26B 1/044
2018/0290313 A1 * 10/2018 Scimone ..... B26B 5/00
2020/0290219 A1 * 9/2020 Scimone ..... B26B 5/00

* cited by examiner

EVERYDAY FOLDING UTILITY CUTTER

FIELD OF THE INVENTION

The present invention generally relates to a compact utility cutter. Specifically, embodiments of the present invention relate to an everyday use utility knife apparatus with a foldable blade holder.

BACKGROUND

Utility knives are well known and used for a wide variety of tasks because of their convenient shape and size, and sharp razor-like blade. Current foldable utility knives include blades that are pivotable to an open or closed position. However, these foldable utility knives lack a compact and ergonomic handle structure and configuration which permits a blade or blade holder to be pivoted to an open or unfolded position, in particular, when only using one hand.

Moreover, traditional utility knives lack blade holders or the ability to conveniently eject or disengage blades from blade holders resulting, in some instances, in trouble associated with removing and/or exchanging the blades in knives that include that functionality. For example, some knives with blade holders are unreliable or unsafe in securing the blade in the holder, or the procedure to remove and exchange the blade is awkward, complicated, or unsafe.

Therefore, there is a need in the art for a folding knife that improves one or more of these problems, or additional problems. In particular, there is a need for a folding knife that permits easy replacement of blades, better secures the replaceable blade to the blade holder, prevents the blade from moving, and the user from injury when the knife is in an open or closed position, or any positions in between. Moreover, there is a need for a compact folding knife which may be pivoted into its open position using one or more fingers. Additionally or alternatively, there is a need for a folding knife configured for ambidextrous use. Furthermore, there is a need for a folding knife with a blade holder, in particular in knives with exchangeable blades, where the blade can be locked in place, but can be easily unlocked, for example, for changing the orientation of the blade, for exchanging the blade for a new one, or for one of a different type. These and other features and advantages of the present invention will be explained and will become obvious to one skilled in the art through the summary of the invention that follows.

SUMMARY OF THE INVENTION

Accordingly, it is an aspect of the present invention to provide a folding utility knife with a handle module and a pivoting blade module having a powerful and smooth tension-loaded deployment mechanism. Furthermore, it is an aspect of the present invention to provide a utility knife whose blade could be easily exchanged or replaced, for example, without the need for extra tools.

According to an embodiment of the present invention, a folding utility knife includes: a blade, a handle module having a front panel including a tension-loaded deployment mechanism, a rear panel including a locking plate, the front panel and rear panel connected to one another at one or more connection points to form a blade module chamber, a blade module operably connected to the handle module at or near a first connection point, the blade module comprising an actuator release and a blade holder having one or more blade retention layers, one or more locking pins, a blade channel extending from a blade outlet slot, and a blade release switch, and a hinge module configured to permit the controlled or selective deployment of the blade holder, for example, the rotation of the blade holder about an axis disposed on the blade handle.

According to an embodiment of the present invention, the tension-loaded deployment mechanism may be configured to assist in the movement of the blade module from a first closed, or folded position, to a second open, or unfolded position upon a user's selective engagement of the actuator release.

According to embodiments of the present invention, the tension-loaded deployment mechanism may be configured to bias the blade holder to the open or unfolded position when an external pressure, for example, a rotational external force, is applied to the blade module to activate the spring of the deployment mechanism.

According to embodiments of the present invention, the tension-loaded deployment mechanism may be configured to retain the blade holder in the closed or unfolded position when the blade holder is in the folded or closed position.

According to an embodiment of the present invention, the rear panel of the handle module may include a locking plate. In some embodiments, the locking plate includes a locking arm. The locking plate, locking arm, or both, may be loaded with elastic potential energy. For example, the locking arm may include a bend or similar curve adapted to bias the arm towards the front panel of the handle module. When the blade module is moved to the open or unfolded position, the biased locking arm may be configured to automatically extend from the rear panel to block or otherwise prevent the rearwards movement of the blade holder such that the blade holder is prevented from unintentionally moving back to the closed or folded position, for example, while the blade is in use.

According to an embodiment of the present invention, the blade module may be configured with a blade channel configured to retain at least a portion of the blade within the blade holder, and a blade release switch configured to permit the removal of the blade from within the blade channel.

According to an embodiment of the present invention, the blade release switch may include a tension component configured to bias the blade release switch to engage with and hold the blade substantially in place. The blade release switch may be configured to engage with a notch or hole in the blade to substantially secure the blade in place when the blade release switch is in a first position, for example, when the blade release switch is at rest (i.e. not acted upon by a user), and may be configured to disengage with the blade when the blade release switch is in a second position, for example, when the blade release switch is compressed.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED SPECIFICATION

Figure 1:
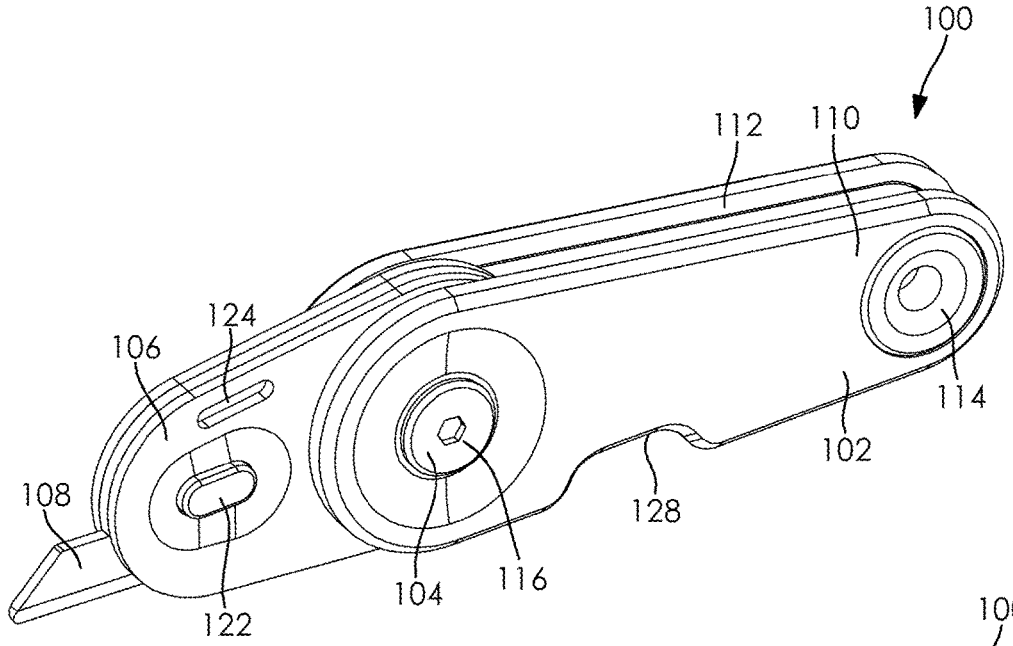
FIG. 1 is a front perspective view of a foldable utility knife with an unfolded blade holder in accordance with an embodiment of the present invention.

The present invention generally relates to a folding utility knife. Specifically, embodiments of the present invention relate to a compact utility knife apparatus with a pivotable or foldable blade module. In accordance with embodiments of the compact folding knife, the device may further include a handle module pivotally connected to the blade module.

According to an embodiment of the present invention, the compact utility knife may comprise a blade module and a handle module joined by a hinge module operably connected to a tension-loaded deployment mechanism. Certain embodiments of the present invention may include fewer components or additional components depending on the utilization and purpose for the compact utility knife.

According to an embodiment of the present invention, a folding utility knife includes: a blade, a handle module having a front panel including a tension-loaded deployment mechanism, a rear panel including a locking plate, the front panel and rear panel connected to one another at one or more connection points to form a blade module chamber, a blade module operably connected to the handle module at or near a first connection point, the blade module comprising an actuator release and a blade holder having one or more blade retention layers, one or more locking pins, a blade channel extending from a blade outlet slot, and a blade release switch, and a hinge module configured to permit the controlled or selective deployment of the blade holder, for example, the rotation of the blade holder about an axis disposed on the blade handle.

According to an embodiment of the present invention, the folding knife may comprise a blade module and a handle module that are joined by a hinge module, through which the blade and handle modules may fold together, such that the blade module can fold away into an inner chamber between the front panel and the rear panel of the handle module, that is adapted to receive the blade module. The handle module and the blade module may be generally of equal or similar length, or the blade module may be smaller, or shorter, so that the blade module may substantially fold away into the handle module, in which case the handle module will be bigger or longer.

According to an embodiment of the present invention, the handle module may be operably connected to the blade module at the hinge module. The handle module may have a top or spine side opposite a bottom or 'belly" side. The spine side of the handle module may be on the same side as the spine of the blade when the knife is in the open position, but when the knife is in the closed position, the spine side of the handle may be on the opposite side as the spine of the blade, for example, it may be on the same side as the blade's cutting edge or "belly" side when the blade switches orientation as it is folded away, into the closed position.

According to an embodiment of the present invention, the folding utility knife may be configured with a closed or folded position in which the blade module is pivoted fully inwards and sits in a chamber configured in the handle module to substantially accommodate the dimensions (length, width) and shape of the blade module, with an open or unfolded position in which the blade module is pivoted fully outward and away from the handle, and with an intermediary position located anywhere between the fully closed or folded position and the fully open or unfolded position.

According to an embodiment of the present invention, the handle module may be comprised of multiple pieces including two panels which may include additional functional components. For example, a front handle panel and a rear handle panel may be connected by two or more connection points and be configured as a chamber to provide space for and substantially accommodate the blade holder once folded in. Each panel may essentially be one piece or multiple pieces, for example, each panel may have an outer shell, for example, to provide surface texture, surface protection, additional stability and/or decoration. The panels and other pieces of the handle may be assembled and fastened to each other using any method and any mechanical or chemical fastener, including for example, screws and/or adhesives.

According to an embodiment of the present invention, the handle module may include a front panel configured to substantially accommodate a tension-loaded deployment mechanism, and related structures (for example, spring-like members and the space/chambers therefor). The front panel may further include a track plate configured with a spring spoke slot. The spring spoke slot may be referred to herein as a blade holder guide. In some examples, the spring member of the tension-loaded deployment mechanism may be disposed between the front panel and the track plate. In some scenarios, the spring spoke slot may be a void configured as a movement boundary for the traveling bit of the spring member. The front panel and the track plate may also include pin receiving holes disposed at the handle connection points, to connect the front panel to the rear panel through pins, screws or any similar fastening members. The front panel may further incorporate a broad indentation on its bottom side configured to permit easy access to the pulling notch disposed on the blade holder.

According to an embodiment of the present invention, the handle module may include a rear panel configured to substantially accommodate a locking plate and related structures (for example, spring-like members and the space/chambers therefor). The locking plate and the rear panel may collectively form a locking pin groove configured as a movement boundary for a locking pin that may extend from the blade holder. The locking pin groove may permit the movement of the locking pin from a first position to a second position. In some examples, the locking pin track includes a first locking pin position which corresponds to the closed position of the blade holder, and a second locking pin position which corresponds to the open position of the blade holder. The locking plate may additionally or alternatively include a locking arm, which may be configured as a lever, to lock the blade holder substantially in place when the blade holder is in the unfolded position. The locking plate, locking arm, or both, may be loaded with elastic potential energy for that purpose. For example, the locking arm may include a bend or similar curve adapted to bias the arm towards the front panel of the handle module. When the blade module is moved to the open or unfolded position, the biased locking arm may be configured to automatically extend from the rear panel to block or otherwise prevent the rearwards movement of the blade holder such that the blade holder is prevented from unintentionally moving back to the closed or folded position, for example, while the blade is in use. The locking arm may also include a gliding protrusion configured to minimize the contact or friction between the locking arm and the blade holder when the blade holder is in the folded position as well as when the blade holder moves from the folded position to the unfolded position and vice versa.

According to an embodiment of the present invention, the blade module may include an actuator release configured to activate or engage the tension-loaded deployment mechanism. The actuator release may be disposed in a position so that it may be conveniently reached when holding the handle, in particular, near the spine side of the handle module and towards the handle module's hinge end. The location may be adapted to be more easily reached by the index finger, or by one or more fingers, in particular, for one-handed release operation. In some examples, the release actuator may be configured as a protruding knob near the hinge end of the blade module. This has the advantage of allowing one-handed operation, for example, by holding the handle with one hand, and using an index finger to engage the actuator release to release the blade module from within the handle module. In some examples, this configuration further permits the ambidextrous use of the knife.

In accordance with embodiments of the present invention, the folding knife may include a tension-loaded deployment mechanism. A substantial portion of the tension-loaded deployment mechanism may be housed within the handle module of the knife. The tension-loaded deployment mechanism may comprise one or more spring-like members configured to bias the blade holder to the open or closed position. In some scenarios, a spring-like member may be loaded with elastic potential energy and be configured to apply a force against blade holder to bias the blade holder to the closed or open positions. In some examples, the tension-loaded deployment mechanism may be employed after the blade holder is partially opened utilizing the actuator release. For example, the blade holder may be partially manually opened using the actuator release to activate the deployment mechanism such that the blade holder may automatically travel to the open position. The spring-like member may include a traveling spoke configured to pass through a receiving hole in the blade holder. The spring-like member may control the position of the blade holder, depending on the position of the traveling spoke, with respect to the blade holder. The traveling spoke may be configured to travel within the slot in the track plate of the front panel. In some embodiments, the slot in the track plate has a substantially semicircular configuration. In some examples, after a user partially opens the blade, for example, by pulling outwardly on the spine side of the blade holder, or pushing downwards on the "belly" side of the blade holder, a selected distance, degree, or arc, the spring-like member applies an expansion force on the blade holder, to push the blade holder to the open or unfolded position. In some embodiments, the blade holder includes a notch, indent, or opening configured as a pulling notch on its spine side, which is accessible when the blade holder is in the folded position and permits a user to easily pull outwardly on the blade holder to engage or activate the tension-loaded deployment mechanism.

According to an embodiment of the present invention, activating or engaging the tension-loaded deployment mechanism may assist in the releasing of the blade module from the folded or closed position, to the unfolded or open position. The tension-loaded deployment mechanism may be configured to assist in the movement of the blade module from a first closed, or folded position, to a second open, or unfolded position upon a user's selective engagement of the actuator release. The tension-loaded deployment mechanism may be configured to retain the blade holder in the closed or unfolded position when the blade holder is in the folded or closed position and may be configured to bias the blade holder to automatically open to the unfolded position when a manual force, for example, a rotational external force, is applied to the blade module to activate the spring-like member of the deployment mechanism.

In accordance with embodiments of the present invention, the blade holder may include a locking pin configured to travel along a track or path disposed on the locking plate of the rear panel. The locking pin may extend from the rear surface of the blade holder and may be configured to travel along the locking plate of the rear panel which may be configured with a locking pin groove or slot having locking pin positions corresponding to a preselected set of blade holder positions. The locking pin may be configured to prevent the over-rotation of the blade holder. In some examples, the combination of the locking plate track and the locking pin define a movement boundary for the blade holder. For example, the locking plate track may extend from an initial position to a final position, wherein the initial position corresponds to the folded position of the blade holder and a final position corresponds to the unfolded position of the blade holder. When the blade holder is in folded position and the locking pin is in the initial position, the blade holder is prevented from over-folding into the handle and similarly, when the blade holder is unfolded and the locking pin is in the final position, the blade holder is prevented from over-rotating, for example, from rotating more than 180 degrees from the folded position.

The blade deployment mechanism may be configured so that once the blade holder reaches the open or unfolded position, the locking pin will move along the locking pin groove to the position that prevents release (for example, now locks the blade in the open position). Applying a force to the locking plate when the knife is in the open position similarly may release the blade holder, which can then be returned into the closed position. The blade deployment mechanism may be configured so that once the closed position is reached, the locking pin is secured at a second position by the locking pin groove which prevents release the of the blade holder.

According to an embodiment of the present invention, the folding knife may comprise a hinge module having a hinge component such as a pivot joint, cylinder, peg or pin. The hinge component may unite the handle module and the blade module at their respective pivot points, for example, the handle module and the blade module may be configured with one or more holes configured to receive a pin, bolt, rivet or peg, and the pin may be configured to fill the hole such that it permits pivoting the two sections around the pin into an open or closed position. The pin may be secured in place by an end piece on each of its opposing sides which may be configured any suitable way, for example, flush with the surface of the handle module (for example, an outer panel thereof), recessed slightly below the surface, or slightly protruding from the surface.

According to an embodiment of the present invention, the blade module may comprise a blade holder configured to securely hold the blade, and a blade configured to securely connect to the blade holder. The blade holder may be configured for a removable/exchangeable blade, and may comprise a blade release switch. The blade release switch may be configured with two positions, one of which locks the blade into position in the blade holder, while the other position unlocks it. In particular, the blade release switch may be configured with a locking protrusion that engages a corresponding notch in the blade to secure it in place, and may be further configured to move the locking protrusion out of the notch to release the blade for removal or exchange. For example, the blade release switch may be configured as a push button that unlocks the blade while pressing the outer button surface down and thus moving the connected locking protrusion out of the notch of the blade. The blade release switch may be further configured to automatically return the locking protrusion into its locked position when the push button is released by action of a spring, for example a coil or leaf spring configured below the blade release switch inside the blade holder, that upon release of pressure on the button, the button springs back into its original shape and thus pushes the blade release switch (including the button and the locking protrusion) up again, moving the blade release switch, and its locking protrusion, back into its locking position that engages the notch in the blade. The coil or leaf spring may be located inside a recess of the blade holder configured to hold a spring of suitable compressibility to return the push button into its original position upon its release. In some examples, the rear side of the blade holder may include a recess configured to receive the back end of the blade release switch to permit the blade release switch to move from the locked position to the unlocked position. The blade release switch allows a user to change the orientation of the blade from a used or dull side to an unused or sharp side or to easily exchange the blade with a new or different blade of a different type (for example, different material or shape, for example, serrated/unserrated blade, ceramic/metal blade, and the like), and safely lock the desired blade or the original blade in the desired orientation.

According to embodiments of the present invention, the blade may be configured with a spine and a cutting edge on opposite sides of its width, and a front tip and a rear tip on opposite sides of its length. The blade may be permanent or exchangeable, and may be secured in the blade holder by any suitable means, including one or more of numerous fasters such as rivets, bolts and screws, friction fit, adhesives, and combinations thereof. For example, the blade holder may be configured to provide a friction fit by its tight fitting structure. Alternatively or additionally, the blade holder may be configured from one or more blade retention layers joined securely by screws, and the friction between at least two of the blade retention layers and the blade may keep the blade secured. The blade retention layers and other pieces of the blade holder may be fastened to each other using any method and any mechanical or chemical fastener, including for example, screws and/or adhesives. Moreover, the blade may be configured with a notch to be secured by a corresponding structure in the blade holder such as the blade release switch as described herein for a removable/exchangeable blade. In case of a permanent blade, the lock does not need to be configured with a second unsecured position as described. If the blade is permanent, alternatively or additionally, it may be secured by adhesives or a friction fit as described herein below.

In an embodiment of the present invention, a portion of the blade inside the blade holder may be configured to engage with a protruding structure of the blade holder, for example, the blade release switch, and thus prevent movement of the blade when engaged, for example, the blade does not pull out, for example, during use of the blade. In some scenarios, the blade may be configured with a notch, slot or hole to engage a blade release switch as described for removable/exchangeable blades, or to engage a corresponding structure of the blade holder such as a protrusion, pin, peg or corner, and thus secure a permanent blade.

According to an embodiment of the present invention, the blade holder may be configured with a removable/exchangeable blade, and may additionally be configured with a friction means to increase friction sufficiently when the blade is unlocked to prevent the blade from slipping out, but allow it to be pulled out or inserted easily. For example, such a friction means may take the form of a leaf spring comprised in a recess of the blade holder and configured to make contact with one of the two broad sides of the blade, and press it towards a wall of the blade holder in contact with the opposite broad side of the blade with pressure high enough to prevent slippage but low enough to allow removal and insertion of the blade. Similarly, in case of a permanent blade, the leaf spring may be used to secure the blade alone or in combination with other fasteners, depending on the pressure that the leaf spring is configured to exert.

According to an embodiment of the present invention, the blade may take any one of numerous forms suitable for use in a utility knife, such as trapezoidal, hooked, rectangular, and segmented for snap-off (for example, with one or more segments that can be removed from the blade to expose a fresh cutting edge). The cutting edge of the blade may take any one of numerous different configurations of cutting edges, including straight and serrated.

According to an embodiment of the invention, one or more of the handle and the blade holder, or any parts thereof, may be formed from a suitable thermoplastic material, which may include, for example, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), Engineered Thermoplastic Polyurethane (ETPU), or any combination thereof.

According to an embodiment of the invention, one or more of the handle and the blade holder, or any parts thereof, may be formed from a suitable metal material, which may include, for example, tungsten, iron, molybdenum, cobalt, vanadium, steel, for example, carbon steel, alloy steel, stainless steel, austenitic steel, ferritic steel, martensitic steel, or any combination thereof.

According to an embodiment of the present invention, the blade used in the folding knife of the present invention may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention. Alternatively, embodiments of the present invention may be used with standard blades, for example, a metal or steel blade. According to an embodiment of the present invention, the blade may be configured with a rounded tip to reduce the chance of injury.

FIG. 1 shows a front perspective view of a folding knife in an open position in accordance with an embodiment of the present invention. In the depicted example, the folding knife 100 is shown in the open or unfolded position and includes a handle 102, a hinge 104, a blade holder 106, and a blade 108. The handle 102 may be comprised of a blade holding chamber, a front panel 110 and a rear panel 112. In the illustrated example, the front panel 110 and the rear panel 112 are operably connected at least by a first fastener 114 and a second fastener 116. In the depicted example, the first fastener 114 is configured as a pin with a receiving hole. The receiving hole disposed on the first fastener may be configured to receive a lanyard and similar hanging or latching elements. In the depicted example, the second fastener 116 is configured to connect the handle 102 to the blade holder 106. In some embodiments, the second fastener 116 may be configured as a hinge 104, about the axis of which the blade holder 106 may be configured to rotate. In the depicted example, the blade holder 106 includes a pulling notch 124. In some embodiments, the knife 100 may include a blade release switch 122 configured with two positions, one of which locks the blade 108 into position in the blade holder 106, while the other position unlocks it. In the depicted example, the blade release switch 122 is shown in the locked position wherein the blade 108 is locked into position.

Figure 2:
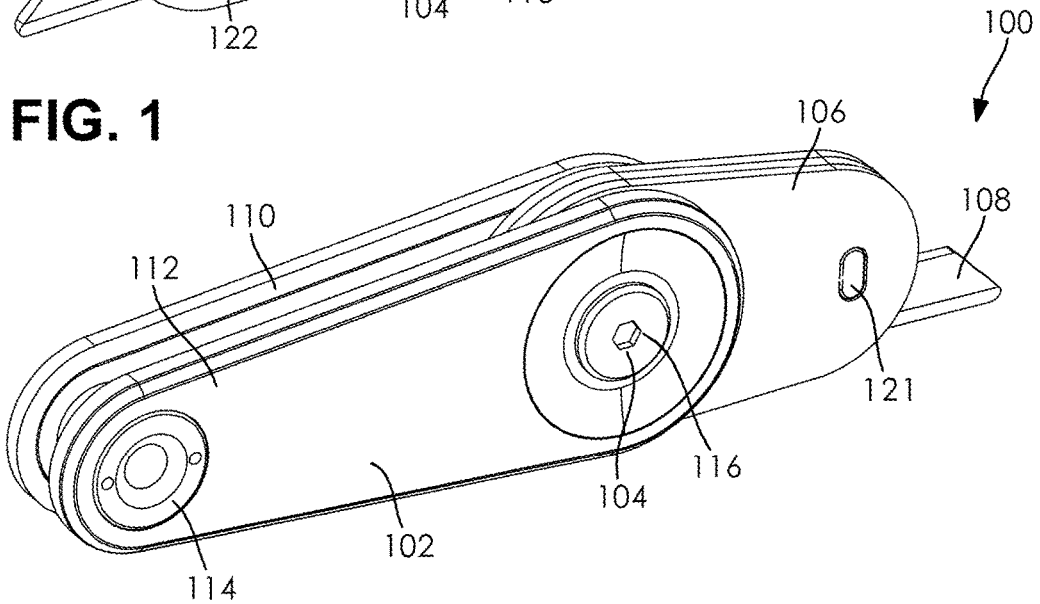
FIG. 2 is rear perspective view of a foldable utility knife with an unfolded blade holder in accordance with an embodiment of the present invention.

FIG. 2 shows a rear perspective view of a folding knife in an open position in accordance with an embodiment of the present invention. In the illustrated embodiment, the folding knife 100 is shown in the open or unfolded position and includes a handle 102, a hinge 104, a blade holder 106, and a blade 108. As shown in the depicted example, the front panel 110 and the rear panel 112 of the handle 102 may be joined by one or more fasteners, for example, a first fastener 114 and a second fastener 116. In the illustrated example, the rear side of the blade holder 106 includes a recess configured to receive the locking protrusion 121 of the blade release switch 122 to permit the blade release switch 122 to move forwards and rearwards within the blade holder 106, for example, to move from a forward or locked position to a rearwards or unlocked position.

Figure 3:
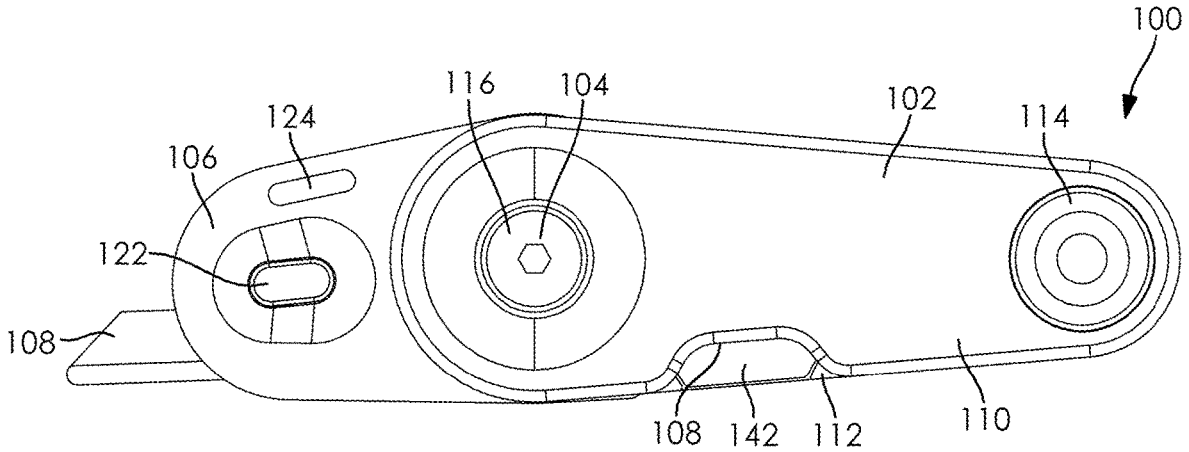
FIG. 3 is a front view of a foldable utility knife with an unfolded blade holder in accordance with an embodiment of the present invention.

FIG. 3 shows a front view of a folding knife in an open position in accordance with an embodiment of the present invention. In the depicted example, the folding knife 100 includes a handle 102, a hinge 104, a blade holder 106, a blade 108, and a blade release switch 122. As shown in the illustrated example, the front panel 110 may further include a broad indentation 128 on its bottom side configured to permit easy access to the pulling notch 124 disposed on the blade holder 106 when the blade holder 106 is in the folded or closed position. In the depicted example, a locking arm 142 extends from the rear panel 112 to block the blade holder 106 from folding back into the blade holding chamber of the handle 102.

Figure 4:
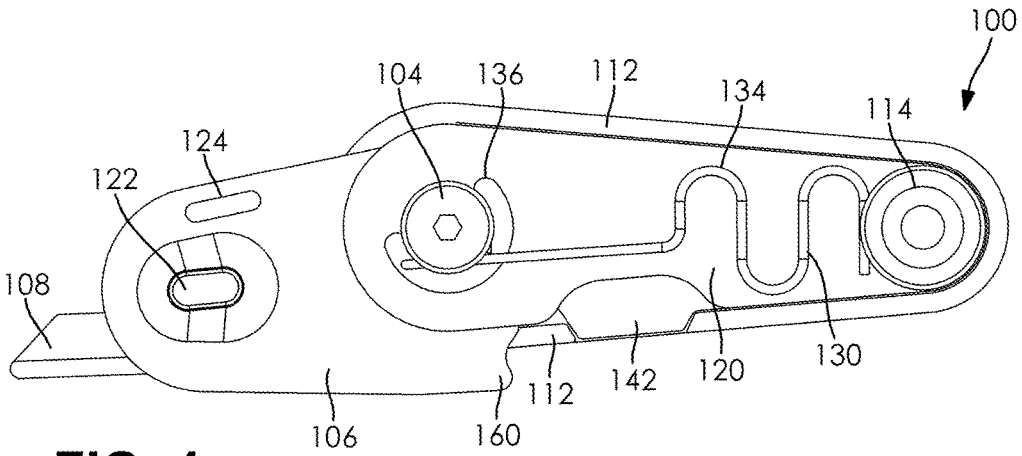
FIG. 4 is a front view of a foldable utility knife with an unfolded blade holder and the front panel removed in accordance with an embodiment of the present invention.

FIG. 4 shows a front view of a folding knife in an unfolded or open position in accordance with an embodiment of the present invention. In the illustrated example, the front panel (not shown) is removed to show a portion of the internal components of the knife 100. In the depicted example, the tension-loaded deployment mechanism of the folding knife 100 comprises a spring-like element 130. In the illustrated example, the spring-like element 130 biases the blade holder 106 to the unfolded position. The spring 130 may have a first end comprising a traveling spoke component 132 and a second end comprising a coiled, bent or serpentine component 134. In some embodiments, the spring 130 may be loaded with elastic potential energy. As shown in the illustrated example, the spring 130 may be substantially disposed in the front panel 110 of the knife 100. The traveling spoke 132 of the spring 130 may be configured to travel through a receiving hole 118 in the blade holder 106. The front panel 110 of the knife 100 may include a track plate 120 configured with a spring spoke slot 136 defining pin positions corresponding to a preselected set of blade holder positions. For example, when the traveling spoke 132 is positioned in a first end of the spring spoke slot 136 (as shown in FIG. 5), the blade holder 106 may be configured to be in the closed or folded position wherein the blade holder 106 and the blade 108 are substantially housed within the handle, and when the traveling spoke 132 is positioned in a second end of the spring spoke slot 136 (as shown in FIG. 4), the blade holder 106 may be configured to be in the open or unfolded position, wherein the blade holder 106 and at least a portion of the blade 108 are unfolded from the blade holding chamber and the blade 108 may be substantially exposed.

Figure 5:
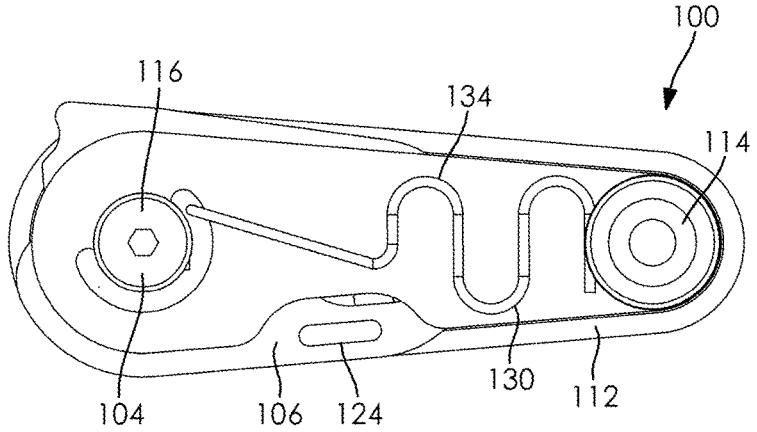
FIG. 5 is a front view of a foldable utility knife with an folded blade holder and the front panel removed in accordance with an embodiment of the present invention.

FIG. 5 shows a front view of a folding knife in a folded or closed position in accordance with an embodiment of the present invention. In the illustrated example, the front panel (not shown) is removed to show a portion of the internal components of the knife 100. In the depicted example, the tension-loaded deployment mechanism of the folding knife 100 comprises a spring-like element 130. In the illustrated example, the spring-like element 130 biases the blade holder 106 towards the folded position. In the depicted example, the spring 130 includes a first end comprising a traveling spoke component 132 and a second end comprising a coiled, bent or serpentine component 134. In some embodiments, the spring 130 may be loaded with elastic potential energy. In the depicted example, the spring 130 is substantially disposed in the front panel 110 of the knife 100. In the illustrated example, the traveling spoke 132 of the spring 130 travels through a receiving hole 118 in the blade holder 106. In the illustrated example, a track plate 120 having a spring spoke slot 136 is configured with pin positions corresponding to a preselected set of blade holder positions.

Figure 6:
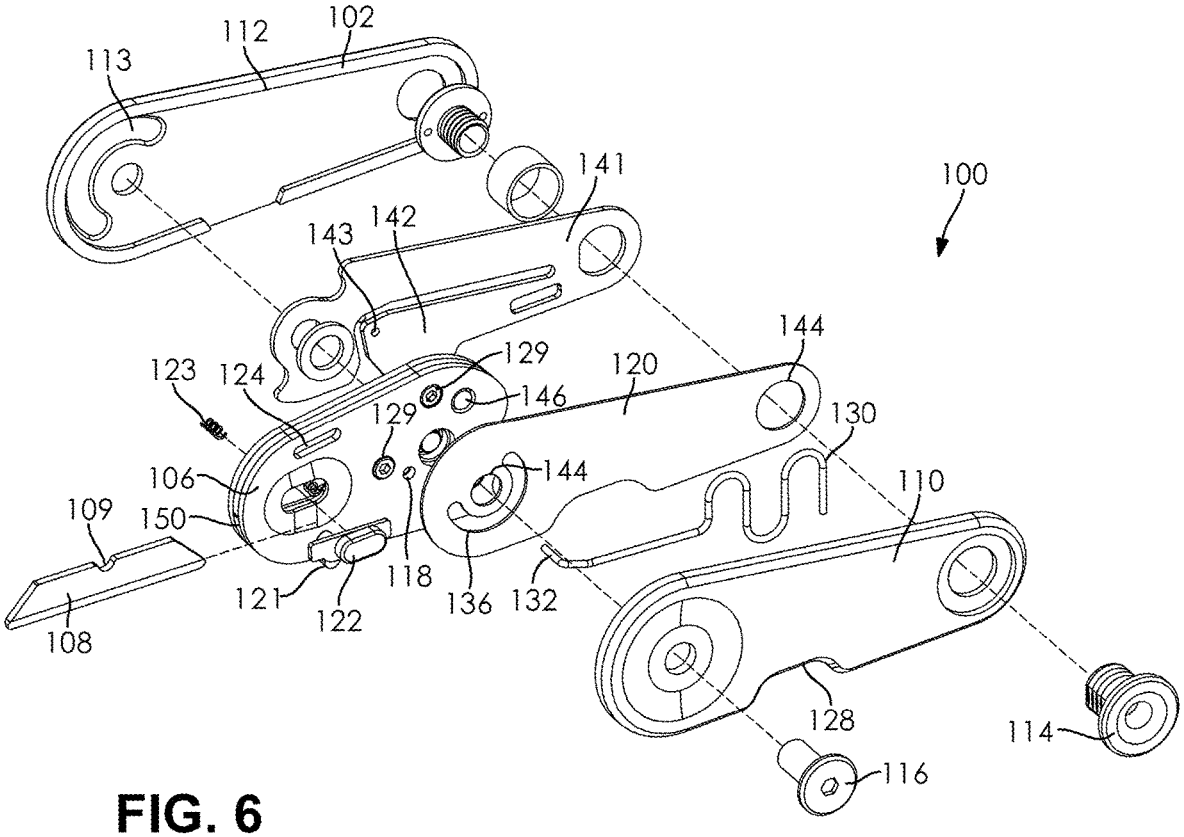
FIG. 6 is a top front exploded view of a foldable utility knife with an unfolded blade holder in accordance with an embodiment of the present invention.
Figure 9:
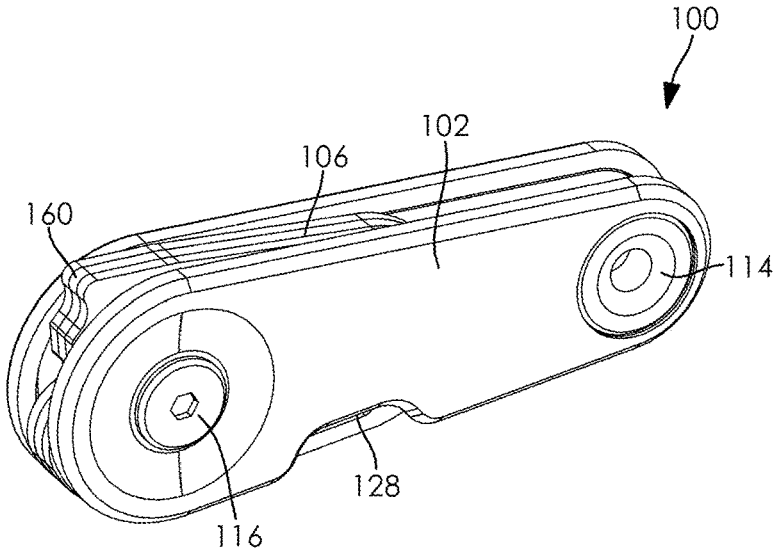
FIG. 9 is a front perspective view of a foldable utility knife in a folded position in accordance with an embodiment of the present invention.

FIG. 6 shows an exploded view of a folding knife in accordance with an embodiment of the present invention. As shown in the depicted example, in some embodiments, the folding knife 100 may comprise a blade 108, a handle 102 having a front panel 110 including abroad indentation 128, one or more fastener receiving holes 144, and a tension-loaded deployment mechanism comprising a spring-like member 130 and a track plate 120 having a spring spoke slot 136, the folding knife 100 further comprising a rear panel 112 including a locking plate 141 having a locking arm 142 and a locking pin groove 113, a blade holding chamber, a blade holder 106 operably connected to the handle 102 at or near a first connection point, the blade holder 106 comprising an actuator release 160 (as shown in FIG. 9) and one or more blade retention layers 127, one or more locking pins 146, a blade channel 148 configured to retain the blade 108 extending from a blade outlet slot 150, and a blade release switch 122. In the depicted example, the locking arm 142 includes a gliding protrusion 143 configured to minimize the contact or friction between the locking arm 142 and the blade holder 106 when the blade holder 106 is in the folded position as well as when the blade holder 106 moves from the folded position to the unfolded position and vice versa.

Figure 7:
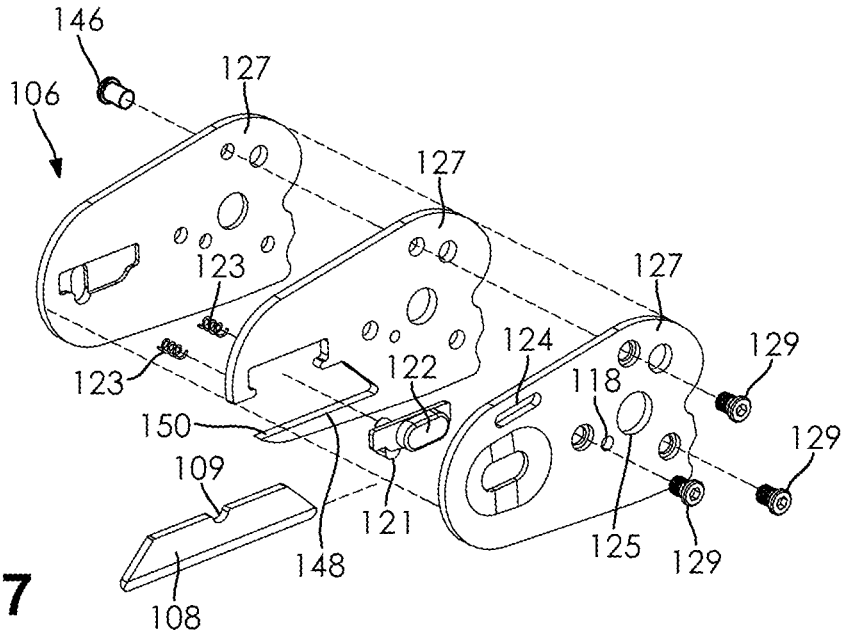
FIG. 7 is a top front exploded view of a blade holder of a foldable utility knife in accordance with an embodiment of the present invention.

FIG. 7 shows an exploded view of the blade holder in accordance with an embodiment of the present invention. In the depicted example, the blade holder 106 includes one or more blade retention layers 127, one or more retention layer fasteners 129, a fastener receiving hole 125, a blade release switch 122, one or more switch receiving holes 126, a spring 123, a pulling notch 124, and a spring spoke receiving hole 118. In the illustrated example, the fastener receiving hole 125 is configured to receive and retain the second fastener 116 to connect the blade holder 106 to the handle 102. The blade holder 106 may be configured to rotate about the axis of the second fastener 116 configured as a hinge 104. In the illustrated example, the spring spoke receiving hole 118 is configured to receive and retain the traveling spoke 132 of the spring 130. In some examples, the spring 130 exerts a force on the spring spoke receiving hole 118 to move or rotate the blade holder 106 about the axis of the hinge 104. In the depicted example, the retention layers 127 are fastened to each other by retention layer fasteners 129. In any embodiment, the blade retention layers 127 and other pieces of the blade holder 106 may be fastened to each other using any method and any mechanical or chemical fastener, including for example, screws and/or adhesives.

As further shown in FIG. 7, the blade release switch 122 may be configured with a locking protrusion 121 that engages a corresponding notch 109 in the blade 108 to secure the blade 108 in place, and may be further configured to move the locking protrusion 121 out of the notch 109 to release the blade 108 for removal or exchange. As shown in the depicted example, the blade release switch 122 may be configured as a push button that unlocks the blade 108 while pressing the outer button surface down and thus moving the connected locking protrusion 121 out of the notch 109 of the blade 108. The blade release switch 122 may be further configured to automatically return the locking protrusion 121 into its locked position when the push button is released by action of the release spring 123 disposed below the blade release switch 122 inside the blade holder 106, that upon release of pressure on the button, the button springs back into its original shape and thus pushes the blade release switch 122 (including the button and the locking protrusion 121) up again, moving the blade release switch 122, and its locking protrusion 121, back into its locking position that engages the notch 109 in the blade 108. In the illustrated example, the release spring 123 is located inside a recess of the blade holder 106 configured to hold a spring of suitable compressibility to return the blade release switch 122 into its original position upon its release. In some examples, the rear side of the blade holder 106 may include a recess configured to receive the back end of the blade release switch 122 to permit the blade release switch 122 to move from the locked position to the unlocked position.

Figure 8:
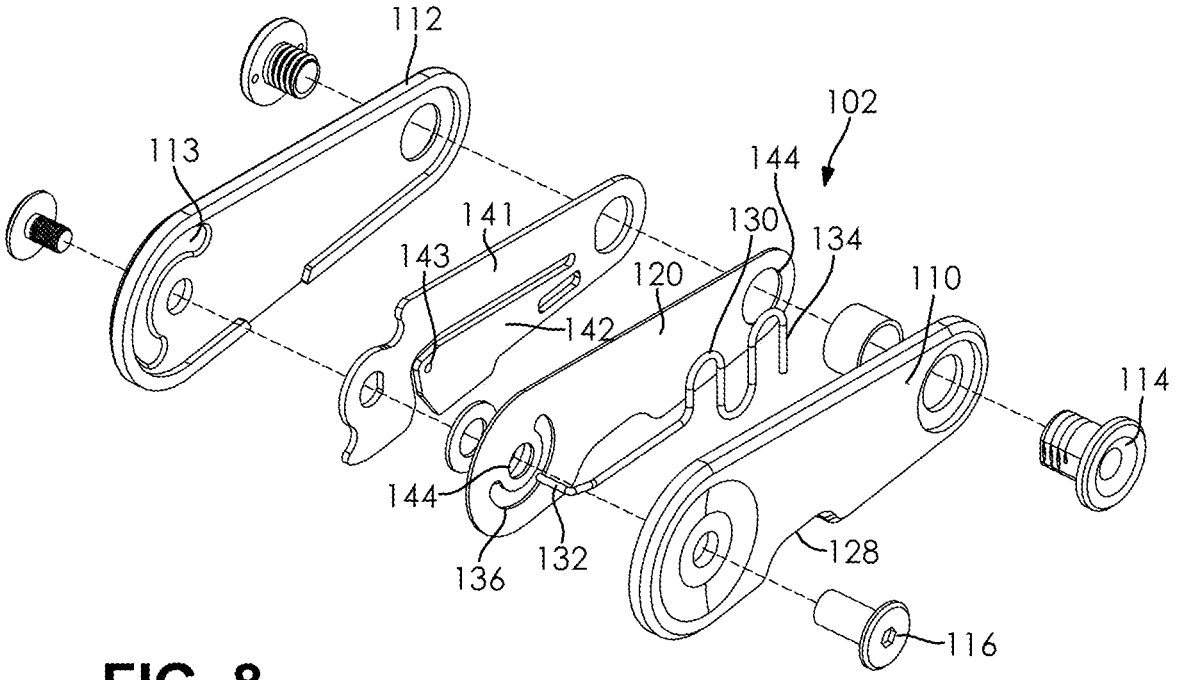
FIG. 8 is a top front exploded view of a handle of a foldable utility knife in accordance with an embodiment of the present invention.

FIG. 8 shows an exploded view of a handle in accordance with an embodiment of the present invention. As shown in FIG. 8, the handle 102 may include a front panel 110 and a rear panel 112. In the depicted example, the front portion of the handle 102 includes a spring-like element 130 having a bent or serpentine component 134 and a traveling spoke 132 configured to travel through a spoke slot 136 in a track plate 120 and into a blade holder (not shown) to control the position of the blade holder (not shown) relative to the handle 102. As shown in the depicted example, the front panel 110 may include a broad indentation 128, one or more fastener receiving holes 144, and a tension-loaded deployment mechanism comprising a spring-like member 130 and a track plate 120 having a spring spoke slot 136. As shown in the illustrated example, the rear panel 112 may include a locking plate 141 having a locking arm 142 and a locking pin groove 113. In the depicted example, the locking arm 142 includes a gliding protrusion 143 configured to minimize the contact or friction between the locking arm 142 and the blade holder 106 when the blade holder 106 is in the folded position as well as when the blade holder 106 moves from the folded position to the unfolded position and vice versa.

Figure 10:
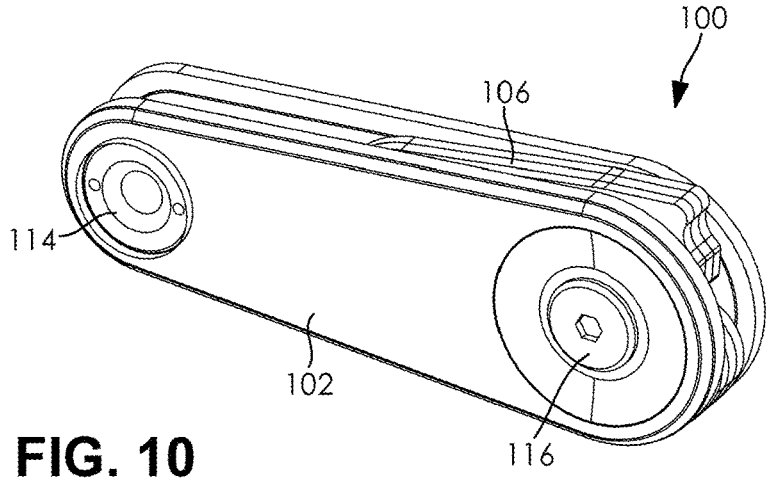
FIG. 10 is a rear perspective view of a foldable utility knife in a folded position in accordance with an embodiment of the present invention.
Figure 11:
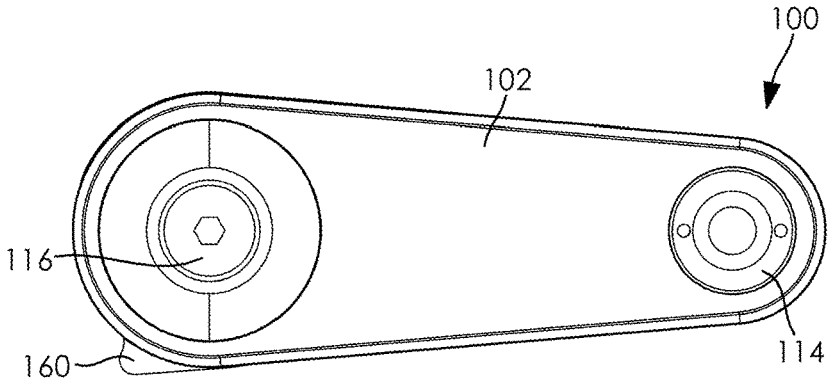
FIG. 11 is a front view of a foldable utility knife in a folded position in accordance with an embodiment of the present invention.

FIG. 9 shows a front perspective view of a knife in a folded position in accordance with embodiments of the present invention. FIG. 10 shows a rear perspective view of a knife in a folded position in accordance with embodiments of the present invention. FIG. 11 shows a front view of a knife in a folded position in accordance with embodiments of the present invention. As shown in FIGS. 9-11, the folding knife 100 may include a handle 102, a hinge 104, and a blade holder 106 having an actuator release 160. As shown in the depicted example, the front panel 110 and the rear panel 112 of the handle 102 may be joined by one or more fasteners, for example, a first fastener 114 and a second fastener 116. As shown in the illustrated example, the front panel 110 may further include a broad indentation 128 on its bottom side configured to permit easy access to the pulling notch 124 disposed on the blade holder 106 when the blade holder 106 is in the folded or closed position.

In an exemplary usage scenario, a closed folding knife 100 (for example, the closed knife shown in FIG. 9) may be opened by a user by pressing the actuator release 160 or by tugging on the pulling notch 124 to activate the tension-loaded deployment mechanism. When the blade holder 106 is moved beyond a predetermined angle, the spoke component 132 of the spring 130, connected to the blade holder 106, may travel within the spoke slot 136 to swing the blade holder 106 to the open position (for example, the open knife shown in FIG. 1). When the blade holder is fully opened, the spoke 132 may be secured by the spoke slot, to lock the blade in its open position. Moreover, when the blade holder 106 is fully open, the locking pin 146 extending from the blade holder 106 may be secured in position by the locking groove 113 in the rear panel 112 to prevent the over-rotation of the blade holder 106. In some scenarios, the locking arm 142 of the locking plate 141 is further configured to reversibly lock the blade holder 106 in the open position by extending out of the rear panel 112 to block the rearwards movement of the blade holder 106 such that the blade holder 106 may not close inadvertently. In some examples, a user may close the blade holder 106 by compressing the locking arm 142 to permit the movement of the blade holder 106 into the handle 102, and manually pushing the blade holder 106 into the blade holder chamber. The blade holder 106 the spring 130 of the tension-loaded deployment mechanism may then maintain the blade holder 106 in the closed position by exerting a force on the blade holder 16, through the receiving hole 118.

In accordance with another exemplary usage scenario, a user may remove or replace a blade using the blade release switch. 122. A user may move the blade release switch 122 from a first position which locks the blade 108 into position in the blade holder 106 into a second position to unlock the blade 108 from the blade holder 106. When the blade release switch is in the first or "locked" position, the locking protrusion 121 of the blade release switch 122 engages a corresponding notch 109 in the blade 108 to secure it in place. When the user moves the blade release switch 122 to the second position, for example, by compressing the blade release switch 122, the locking protrusion 121 may move out of the notch 109 to release the blade 108 for removal or exchange. In some examples, when the user releases the blade release switch 122, the blade release switch 122 may automatically return the locking protrusion 121 into its first or "locked" position by action of a spring 123, for example, a coil or leaf spring configured below the blade release switch 122 inside the blade holder 106, that upon release of pressure on the button, the button springs back into its original shape and thus pushes the blade release switch 122 (including the locking protrusion) up again, moving the blade release switch 122, and its locking protrusion 121, back into its first or "locked" position that engages the notch 109 in the blade 108. In some scenarios, the blade release switch 122 allows a user to change the orientation of the blade 108 from a used or dull side to an unused or sharp side or to easily exchange a first blade with a new or different blade of a different type (for example, different material or shape, for example, serrated/unserrated blade, ceramic/metal blade, and the like), and safely lock the desired blade or the original blade in the desired orientation.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A foldable device, comprising:

a handle formed by a plurality of panels and configured with a blade holder chamber, one of the plurality of panels including a groove;

a track plate disposed between the plurality of panels, the track plate including a slot;

a blade holder having a first end formed with a blade channel configured to removably receive a blade and a second end pivotally connected to the handle, wherein the blade holder is movable between a closed position in which the blade holder rests within the blade holder chamber and an open position in which the first end of the blade holder extends away from the handle; and a release member for assisting in the opening of the blade holder including one or more tension components configured to bias the blade holder towards the open position when the blade holder is manually moved from the closed position;

wherein the one or more tension components includes a portion that extends through the slot and is received in an aperture of the blade holder; and wherein a locking pin extends from the blade holder and is received in the groove, the locking pin moving along the groove as the blade holder moves between the open position and the closed position.

2. The foldable device of claim 1, wherein the blade holder includes a blade release switch configured to releasably secure at least a portion of the blade within the blade channel.

3. The foldable device of claim 1, wherein the blade holder includes a blade retention layer, which includes the aperture that is a receiving hole, and the portion of the one or more tension components extends through the slot when the portion is received in the receiving hole.

4. The foldable device of claim 1, wherein the blade holder includes a plurality of blade retention layers, at least one of the blade retention layers including a switch receiving hole that receives a blade release switch, the blade release switch including a locking protrusion configured to releasably engage with a notch formed in the blade that is retained by the blade channel of the blade holder.

5. The foldable device of claim 1, wherein the portion of the one or more tension components that extends through the slot and is received in an aperture of the blade holder is configured to push against a wall portion of the blade holder that forms the aperture.

6. The foldable device of claim 1, wherein both of the groove and the slot have a semicircular configuration.

7. A foldable device, comprising:

a handle formed by a pair of panels and configured with a blade holder chamber, one of the pair of panels including a groove;

a track plate disposed between the pair of panels, the track plate including a slot;

a blade holder having a first end formed with a blade channel configured to removably receive a blade and a second end pivotally connected to the handle, wherein the blade holder is movable between a closed position in which the blade holder rests within the blade holder chamber and an open position in which the first end of the blade holder extends away from the handle; and a release member configured to assist in the opening of the blade holder including a tension component operably engaged with the blade holder, whereby activating the release mechanism biases the blade holder towards the open position;

wherein the tension component includes a traveling spoke that extends from an end portion of the tension component, the traveling spoke extending through the slot and received in a receiving hole of the blade holder; and wherein a locking pin extends from the blade holder and is received in the groove, the locking pin moving along the groove as the blade holder moves between the open position and the closed position.

8. The foldable device of claim 7, wherein the slot is formed as a void which defines a movement boundary for the traveling spoke.

9. The foldable device of claim 7, wherein:

the second end of the blade holder is pivotally connected to the handle by a hinge;

both of the groove and the slot have a semicircular configuration; and the semicircular configuration of the groove extends about an opposite side of the hinge as the semicircular configuration of the slot.

10. A foldable device, comprising:

a handle formed by a pair of panels and configured with a blade holder chamber, one of the pair of panels including a groove;

a blade holder having a first end formed with a blade channel configured to releasably receive a blade, a second end pivotally connected to the handle, and a spoke receiving hole, the blade holder movable between a closed position in which the blade holder rests within the blade holder chamber and an open position in which the first end of the blade holder extends away from the handle;

a track plate disposed within the handle and formed with a spoke slot having at least: a first end corresponding to the blade holder closed position and a second end corresponding to the blade holder open position;

a spring member for assisting in the opening of the blade holder, the spring member having a traveling spoke received within the spoke receiving hole and configured to travel along the spoke slot, whereby the spring member engages with the blade holder to bias the blade holder to the open or closed positions; and a locking plate disposed within the handle and configured to releasably lock the blade holder in the open position;

wherein the spoke receiving hole of the blade holder remains aligned with the spoke slot of the track plate as the blade holder moves between the closed position and the open position relative to the track plate and the handle;

wherein the traveling spoke extends through the spoke slot; and wherein a locking pin extends from the blade holder and is received in the groove, the locking pin moving along the groove as the blade holder moves between the open position and the closed position.

11. The foldable device of claim 10, wherein the spoke slot and the groove have a generally semicircular orientation.

12. The foldable device of claim 10, wherein the second end of the blade holder is pivotally connected to the handle by a hinge.

13. The foldable device of claim 12, wherein the blade holder rotates about the hinge to move from the closed position to the open position.

14. The foldable device of claim 10, wherein the locking plate is formed with a locking arm configured with elastic energy to bias and secure the blade holder in the closed position.

15. The foldable device of claim 10, wherein the spoke slot is configured as a void and defines a movement boundary for the traveling spoke of the spring member.

16. The foldable device of claim 10, wherein the blade holder further comprises a blade release switch having a locking protrusion for engaging a corresponding void or notch in the blade to secure the blade in place.

17. The foldable device of claim 16, wherein the blade release switch is further configured to move the locking protrusion out of the blade void or notch to release the blade.

18. The foldable device of claim 17, wherein the blade holder further comprises a spring element that biases the locking protrusion of the blade release switch towards a forward position to secure the blade in place.

19. The foldable device of claim 18, wherein compressing the blade release switch reversibly compresses the spring element to release the locking protrusion from within the blade void or notch to permit a movement of the blade.

20. The foldable device of claim 10, wherein the pair of panels are connected together by a fastening member at a connection point.

* * * * *